US007802896B2

(12) United States Patent
Swanson

(10) Patent No.: US 7,802,896 B2
(45) Date of Patent: Sep. 28, 2010

(54) HIDDEN TORCHIERE FLOOR LAMP

(75) Inventor: Dennis K. Swanson, Woodland Hills, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 138 days.

(21) Appl. No.: 12/277,238

(22) Filed: Nov. 24, 2008

(65) Prior Publication Data

US 2010/0128471 A1 May 27, 2010

(51) Int. Cl.
*F21V 19/00* (2006.01)

(52) U.S. Cl. ..... 362/171; 362/178; 362/240; 362/249.16

(58) Field of Classification Search ..... 362/145, 362/151, 152, 153.1, 171, 178, 227, 240, 362/249.16, 382, 434, 172
See application file for complete search history.

(56) References Cited

U.S. PATENT DOCUMENTS 4,984,142 A * 1/1991 Garnerone ..... 362/249.01
5,664,879 A * 9/1997 Lai ..... 362/392
6,705,751 B1 * 3/2004 Liu ..... 362/431
7,651,240 B2 * 1/2010 Bayat et al. ..... 362/208
2003/0202340 A1 * 10/2003 Wu ..... 362/101
2006/0268547 A1 * 11/2006 Chen ..... 362/240

* cited by examiner

*Primary Examiner*—Jong-Suk (James) Lee
*Assistant Examiner*—Julie A Shallenberger
(74) *Attorney, Agent, or Firm*—Connolly Bove Lodge & Hutz LLP; Billy A. Robbins

(57) ABSTRACT

A floor lamp which is constructed of a plurality of elongated members having a plurality of rings affixed to an interior surface of each of the elongated members to provide a substantially circular arrangement with a translucent shade extending substantially along the entire length of the elongated members with a stem secured to and extending upwardly from a base and supporting a plurality of low light level bulbs and terminating in a general area lighting means which extends below the upper surface of the shade so that the tubular shade hides the low light level bulbs and the general area lighting means.

16 Claims, 2 Drawing Sheets

HIDDEN TORCHIERE FLOOR LAMP

FIELD OF THE INVENTION

This invention relates to lighting apparatus and more particularly to a torchiere floor lamp in which the torchiere portion of the floor lamp is hidden.

BACKGROUND OF THE INVENTION

Floor lamps and torchieres are well known in the lighting industry The torchiere lamp is a floor lamp which provides general area lighting. General area lighting is lighting equipment which provides illumination for a particular area in a general manner as opposed to providing illumination for the performance of specific tasks such as reading, writing or the like. Table lamps are also well known to the lighting industry. The present invention is directed to a floor lamp structure as opposed to table lamps. Floor lamps are positioned in various areas of a particular structure such as a room and may be decorative or provide lighting for various purposes. Typically, floor lamps include a base which rests upon the floor and include a stem which extends from the base terminating in a lighting device such as an incandescent or fluorescent bulb surrounded by a shade. Applicant is not aware of any floor lamp structure which includes low level lighting to be utilized either for decoration or night lighting along with a torchiere to provide general area lighting with both the low light level and the torchiere being obscured by the lamp shade.

SUMMARY OF THE INVENTION

A floor lamp having a plurality of elongated members disposed in a circular arrangement with a plurality of rings secured to the elongated members at spaced apart positions to provide an integrated stand to support the floor lamp. A tubular translucent shade extends substantially along the entire length of the elongated members and is disposed internally of the plurality of the rings, a base is attached to the elongated members at the lower end thereof and a hollow stem is secured to and extends upwardly from the base. A plurality of low light level lights extend outwardly from the stem and are spaced along the length thereof and a general area light member is affixed to the other end of the stem and is disposed internally of the tubular shade below the upper end thereof.

DETAILED DESCRIPTION

Figure 1:
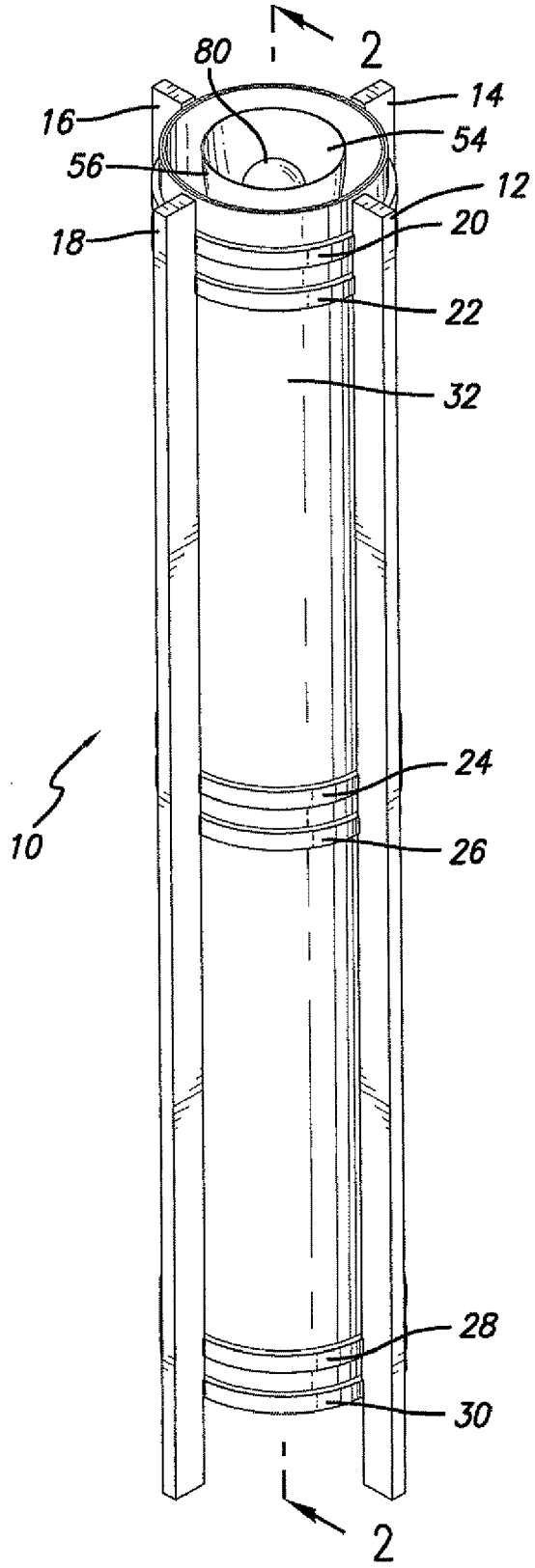
FIG. 1 is a perspective view of a floor lamp constructed in accordance with the principles of the present invention.

Referring now more particularly to FIG. 1, a floor lamp constructed in accordance with the principles of the present invention is illustrated. As is therein shown the lamp 10 includes a plurality of elongated members 12, 14, 16 and 18 and in the preferred embodiment the four elongated members are constructed of wood. It should be understood that the elongated members may be constructed of other materials such as plastic or metal and that they may be three or more in number. Though these wooden members may take various forms they preferably are slat like in appearance and are approximately 1.75 inches in width and approximately 66 inches in length and approximately ¾ of an inch in thickness. It can thus be seen that these elongated wooden members provide a very striking appearance to the lamp. A plurality of metal rings 20, 22, 24, 26, 28 and 30 are affixed permanently to the inside edge of each of the wooden members 12-18 to thereby provide an integrated stand to support the lamp upon a floor. It can thus be seen that the elongated wooden members 12-18 in the preferred embodiment are four in number and are spaced at 90 degree intervals in a circular arrangement. A tubular shade 32 is disposed internally of the metal rings 20-30 and as can be seen from FIG. 1 obscures all of the lighting apparatus disposed internally of the lamp. The shade 32 is constructed of translucent material so that illumination provided by the lighting means disposed internally thereof may be seen through the shade 32. It will become apparent to those skilled in the art that the floor lamp of the present invention as illustrated in FIG. 1 has all of the bulbs which provide illumination from the lamp hidden internally of the shade 32 although the illumination does pass through the shade and as will become more apparent hereinafter the general area lighting casts illumination upwardly from an opening at the top of the shade.

Figure 2:
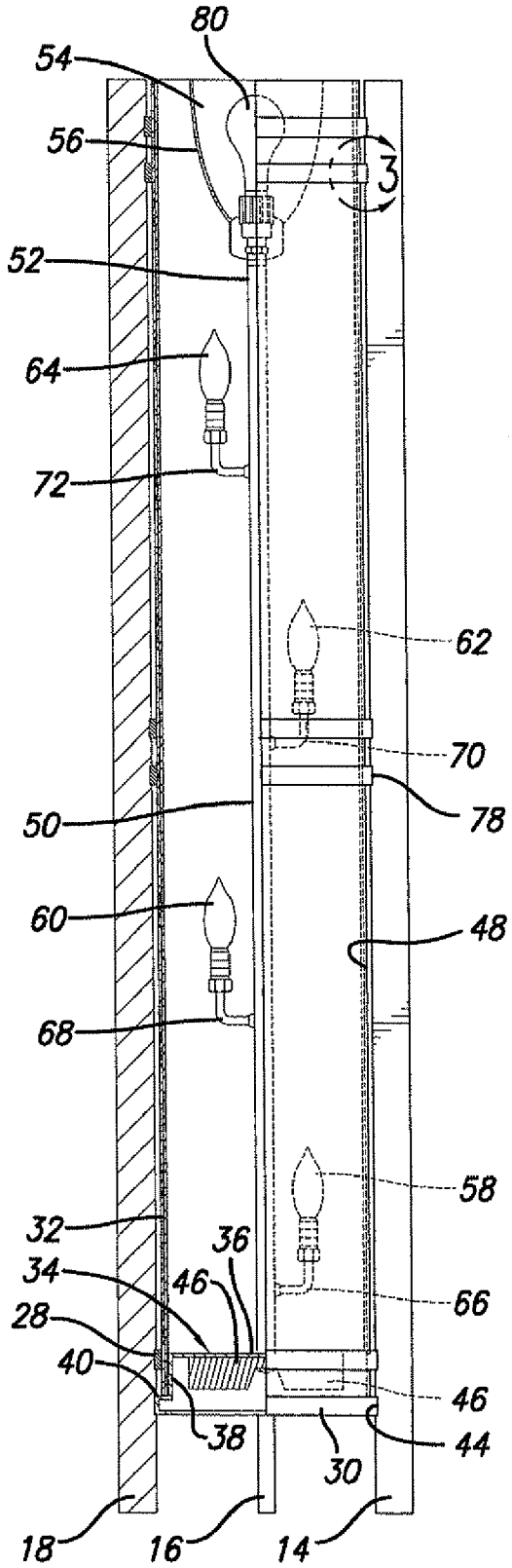
FIG. 2 is a partial cross-sectional view taken about the lines 2-2 of FIG. 1.
Figure 3:
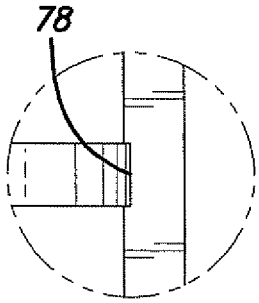
FIG. 3 is an exploded view showing a detail of a portion of the lamp.

Referring now more particularly to FIGS. 2-6, the internal construction of the lamp 10 is illustrated as is therein shown a base 34 is secured to the elongated members such as shown at 14, 16 and 18. The construction of the base is illustrated in greater detail in FIG. 5. As is therein shown, the base 34 is a generally hat shaped member which has an upper planar surface 36, which terminates at its outer periphery in a downwardly directed rim 38. The rim 38 terminates in a flange 40, including a downwardly extending lip 42. The lip 42 is received within a slot formed in each of the wooden member 12-18 one of which is shown at 44 in wooden member 14. Fasteners are then inserted through the lip 42 and into the elongated members 12, 14, 16 and 18 to secure the base in place. As is clearly evident in FIG. 2 the base 34 is displaced upwardly from the lower or first ends of the elongated members 12-18. As is also shown in FIG. 2, a weighted material 46 is affixed to the planar member 36 on the bottom portion thereof The weight 46 is utilized to stabilize the lamp and to prevent it from being easily tipped over during use. As is also evident from FIG. 2 the rim 38 on the base 34 is spaced inwardly from the interior surface of the shade 32. By the rim being displaced from that surface a space is provided for the shade to seat against the flange 40 where it is loosely retained within the metal rings 20 through 30. By loosely retained it is meant that the shade 32 is not affixed to the plurality of rings or the elongated wooden members.

A hollow stem 50 is centrally affixed to the planar surface 36 of the base 34 and extends upwardly therefrom toward the upper or second ends of the elongated wooden members 12 through 18. The upper end 52 of the stem 50 has a general area lighting means 54 affixed thereto. The general area lighting means 54 is in the form of a torchiere structure and includes an upwardly directed cup 56 which may be a reflector or alternatively be constructed of glass, plastic or similar materials that will allow illumination to extend radially outwardly through the shade 28 and at the same time will cause the illumination to be directed upwardly to provide general area lighting for the space within which the floor lamp is situated.

Disposed in a spaced apart relationship along the stem 50 and extending outwardly therefrom are a plurality of low light level bulbs 53, 60, 62 and 64. These bulbs are supported by fittings 66, 68, 70 and 72 which are hollow and are affixed to the outer surface of the hollow stem 50. As is well known to those skilled in the art appropriate electrical wiring will extend through the hollow stem 50 and the fittings 66 through 72 as well as to the general area lighting means 54 to provide electrical energy to the various bulbs that are disposed within the lamp structure. As is also well known to those skilled in the art appropriate switch mechanisms will be connected to the electrical wiring (although such is not shown in FIG. 2) to be able to control the illumination of the low light level bulbs and the general area lighting bulb so that they may be energized separately or collectively as desired.

Figure 4:
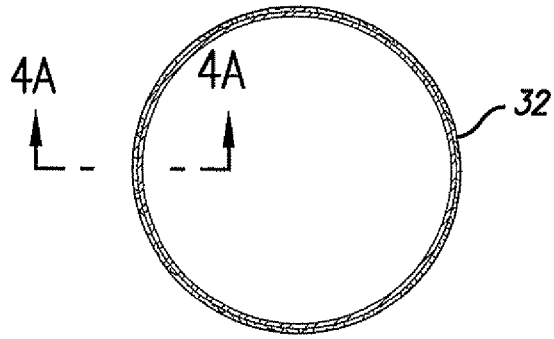
FIG. 4 is a top plan view of the shade.
Figure 4A:
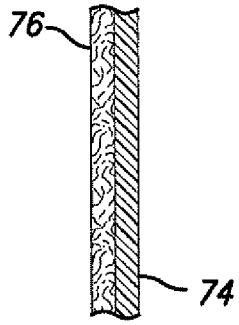
FIG. 4*a* is a partial cross-sectional view showing the details of the shade for the lamp.

The shade 32 in accordance with a preferred embodiment of the present invention is a hollow cylinder as illustrated in FIG. 4. It should be recognized by those skilled in the art that although the shade is shown as a hollow cylinder in FIG. 4 it may take other forms such as square, triangular, diamond shape or polygonal, but in all instances is tubular in configuration so that the stem 50 and the bulbs connected thereto may be housed internally of the lamp. As shown in FIG. 4*a* the shade 28 is constructed from a thin sheet 74 of plastic material, preferably polystyrene, which has secured to the outer surface thereof a fabric 76. The coating of fabric 76 is preferably secured to the outer surface of the plastic sheet 74 by means of an appropriate adhesive.

Figure 6:
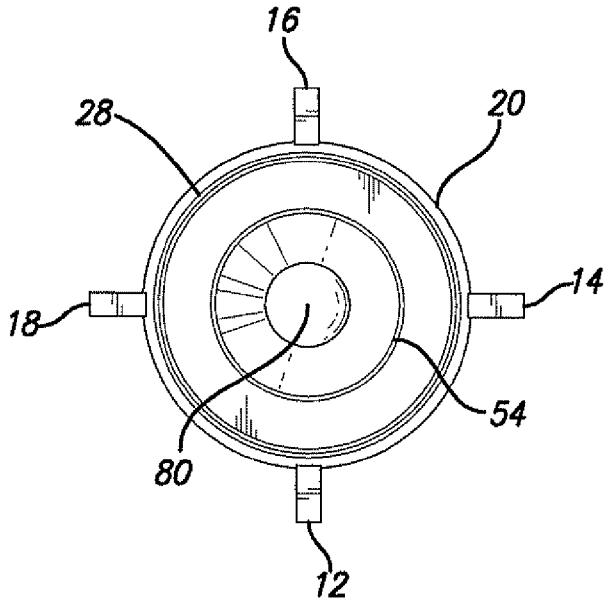
FIG. 6 is a top view of the lamp.
Figure 5:
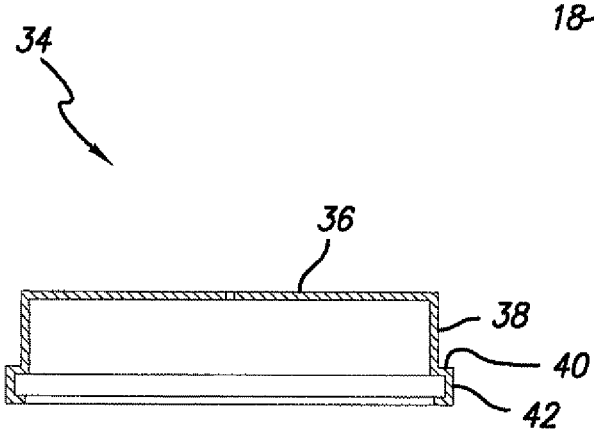
FIG. 5 is a cross-sectional view showing the structure of a base for the lamp.

As shown in FIG. 6 the four elongated members 12 through 18 have the metal rings such as shown at 20 secured thereto by having them seated within the notches such as illustrated at 78 in FIG. 2 by appropriate fasteners to form the essentially circular structure. The shade 28 is then deposited internally of the rings 20 through 30 and is seated upon the flange 40 of the base 34 to support it in position.

There has thus, been disclosed a floor lamp providing low light level lighting along its length in addition to a general area lighting which has a structure such that there is an elongated tubular shade extending substantially the entire length of the lamp which obscures the bulbs and other structure forming the operative portions of the lamp.

What is claimed is:

1. A floor lamp comprising:

(a) a plurality of elongated members having first and second ends disposed in a circular arrangement;

(b) a plurality of rings secured to said elongated members at spaced apart positions along the length thereof to provide an integrated stand to support said lamp;

(c) a tubular translucent shade having a lower end and an upper end extending substantially along the entire length of said elongated members and disposed internally of said plurality of rings;

(d) a base attached to said elongated members adjacent a first end thereof;

(e) a hollow stem having one end secured to said base and extending upwardly therefrom toward said second end of said elongated members;

(f) a plurality of low light level lights extending outwardly from said stem and disposed along the length thereof; and (g) a general area light affixed to the other end of said stem and disposed internally of said tubular shade below said upper end thereof.

2. A floor lamp as defined in claim 1 wherein said rings are metal rings disposed centrally and adjacent to each end of said elongated members.

3. A floor lamp as defined in claim 1 wherein said tubular translucent shade is constructed of plastic.

4. A floor lamp as defined in claim 3 wherein said plastic tubular member includes an outer surface and includes a porous fabric coating secured to said outer surface.

5. A floor lamp as defined in claim 1 wherein said base is a hat shaped metal member having a planar portion and a downwardly depending rim, said rim being affixed to said plurality of elongated members.

6. A floor lamp as defined in claim 5 wherein said rim terminates in a radially outwardly extending flange, said flange including a downwardly extending lip affixed to said plurality of elongated members.

7. A floor lamp as defined in claim 6 wherein said rim is spaced from said plurality of elongated members and said tubular translucent shade resides in said space with the lower end thereof resting on said flange.

8. A floor lamp as defined in claim 7 which further includes a heavy material disposed within said rim and secured to said planar portion of said base.

9. A floor lamp as defined in claim 1 wherein said general area light includes an upwardly directed cup shaped member affixed to the other end of said stem.

10. A floor lamp as defined in claim 2 wherein the plurality of elongated members include four elongated members constructed of wood and disposed ninety degrees apart, and have an inner surface, said inner surface being notched at the center and toward each end thereof, said metal rings being seated within said notches.

11. A floor lamp as defined in claim 6 wherein said base is displaced from said first end of said elongated members.

12. A floor lamp as defined in claim 11 wherein said elongated members are wood and each defines a slot spaced from said first ends thereof and said lip is seated in said slots.

13. A floor lamp as defined in claim 4 wherein said plastic tubular member is a polystyrene plastic cylinder having a fabric coating secured to the outer surface thereof and is loosely retained within said elongated members.

14. A floor lamp as defined in claim 1 wherein said elongated members are constructed of plastic material.

15. A floor lamp as defined in claim 1 wherein said tubular translucent shade is seated at its lower end upon said base.

16. A floor lamp as defined in claim 15 wherein said tubular translucent shade is loosely retained within said rings.

* * * * *